United States Patent [19]

Aggus et al.

[11] 3,976,950

[45] Aug. 24, 1976

[54] ECCENTRIC SUPERCONDUCTING RF CAVITY SEPARATOR STRUCTURE

[75] Inventors: John R. Aggus, Shoreham; Salvatore T. Giordano, Port Jefferson; Henry J. Halama, Shoreham, all of N.Y.

[73] Assignee: The United States of America as represented by the United States Energy Research and Development Administration, Washington, D.C.

[22] Filed: Mar. 20, 1975

[21] Appl. No.: 560,426

[52] U.S. Cl. ..... 328/229; 313/361

[51] Int. Cl.[2] ..... H01J 29/70

[58] Field of Search ..... 328/229, 235; 313/359, 313/361

[56] References Cited

OTHER PUBLICATIONS

Brookhaven National Laboratory Report HADD 73-14.

IEEE Nucl. Sci. NS-20, No. 3, (1973).

*Primary Examiner*—R. V. Rolinec
*Assistant Examiner*—Darwin R. Hostetter
*Attorney, Agent, or Firm*—Dean E. Carlson; Leonard Belkin; Cornell D. Cornish

[57] ABSTRACT

Accelerator apparatus having an eccentric-shaped, iris-loaded deflecting cavity for an rf separator for a high energy high momentum, charged particle accelerator beam. In one embodiment, the deflector is superconducting, and the apparatus of this invention provides simplified machining and electron beam welding techniques. Model tests have shown that the electrical characteristics provide the desired mode splitting without adverse effects.

4 Claims, 5 Drawing Figures

DIMENSION d EXAGGERATED FOR CLARITY

ECCENTRIC SUPERCONDUCTING RF CAVITY SEPARATOR STRUCTURE

BACKGROUND OF THE INVENTION

The invention described herein was made in the course of, or under a contract with the U.S. Atomic Energy Commission and/or its successor the Energy Research and Development Administration.

In the field of accelerators it is advantageous to provide a superconducting deflecting cavity structure for separating high momentum charged particles from a high energy beam, such as is found in the various multi-GeV Alternating Gradient Synchrotrons or terra-electron volt energy machines that have been used or proposed at various places around the world. Such deflectors are advantageous since they consume less power than existing room temperature deflectors; additionally, it is desirable to increase the deflector pulse lengths for bubble chamber experiments and to provide the required long-pulse operating times required for counter experiments, since, heretofore, these desired long pulse lengths have been beyond the capability of conventional room temperature RF power technology.

SUMMARY OF THE DISCLOSURE

This invention provides a superconducting RF separator for a high energy charged particle accelerator beam for extracting charged particles tangentially to an equilibrium axis. More particularly, this invention provides an eccentric-shaped, iris-loaded deflecting cavity for separating and extracting high energy, high momentum, charged particles from an accelerator beam in the energy range of up to over 1000 billion electronvolts. In one embodiment, this invention provides a deflecting cavity means with a conventional RF frequency source, for separating a charged particle beam that is received and transported along the equilibrium axis of the deflecting cavity, comprising a superconducting, eccentric-shaped, iris-loaded deflecting cavity formed from specific disc elements that are welded at abutting joints to form a longitudinally extending cylindrical cross-section cavity. In another aspect, this invention provides a novel method for obtaining mode splitting for an RF separator. With the proper selection of the elements consistent with their fabrication and operation, as described in more detail hereinafter, the desired rf separator and its fabrication and operation are achieved.

It is an object of this invention, therefore, to provide an improved method and RF separator for extracting high energy charged particles from a high energy accelerator beam.

The above and further objects will appear more fully from the following detailed description of one embodiment when the same is read in connection with the accompanying drawings, and the novel features will be particularly pointed out in the appended claims.

BRIEF DESCRIPTION OF THE DRAWINGS

In the drawings, where like elements are referenced alike.

Figure 1:
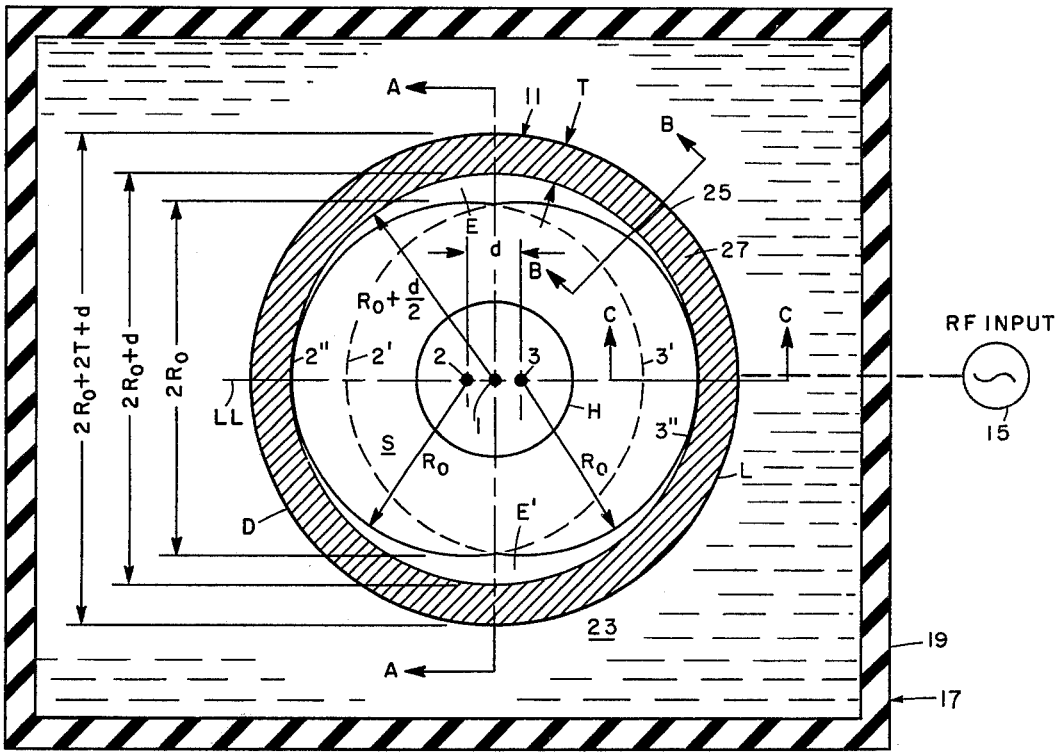
FIG. 1 is a cross-section through the eccentric iris-loaded deflecting cavity means of this invention.
Figure 3:
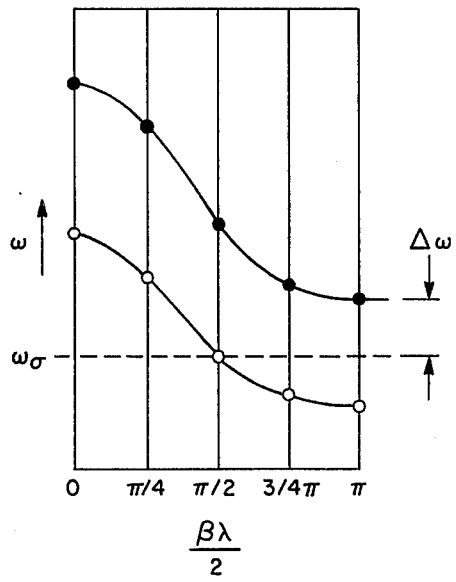

FIGS. *2a–2c* are partial cross-sections of the deflecting cavity means of FIG. 1 through A—A, B—B, and C—C respectively;

FIG. 3 is a graphic illustration of the dispersion curve for the deflecting cavity means of FIG. 1.

DETAILED DESCRIPTION OF ONE EMBODIMENT

The superconducting RF separator of this invention is particularly adapted for 100 GeV K-beams described in Brookhaven National Laboratory Report AADD73-14, since this report describes the advantages of using superconducting RF accelerators with specific high energy beams produced by the Fermi Lab accelerator, Batavia Illinois, but this invention is likewise useful with any of a variety of other particles and beams having energies up to 1000 billion electron volts or more. For example, this invention is useful for extracting charged particles from the 200 × 200 GeV proton-proton Intersecting Storage Accelerator Facility, referred to in the art as "Isabelle", which is described in Brookhaven National Laboratory Report BNL 18891, dated May, 1974.

It is known that 100 GeV/c K-beams can be separated from the Fermi Lab accelerator by a superconducting niobium RF separator employing an iris-loaded deflecting cavity. One such separator that has been proposed is based on the results described and shown in the above-mentioned BNL AADD73-14 report. The separator model, as described in that BNL report, has design parameters, comprising a seven-cell niobium test deflector operating at 8.665 GHz for producing a peak magnetic charged particle separating field of 740 Gauss, which corresponds to a peak electric field of 25 MV/m, and an equivalent deflecting field of 6.9 MV/m that was actually obtained. This invention employs an iris-loaded deflecting cavity means employing an RF source of the type employed in connection with the superconducting RF separator described in the above-cited BNL Report AADD73-14.

In understanding the advantages of this invention, it is known that the different components in high-energy beam of elementary particles can be spatially separated by means of two or three RF deflecting cavities that operate essentially as a time-of-flight analyzer. This is described by B. W. Montague in "Linear Accelerators", edited by P. M. Lapostolle et al., North-Holland Amsterdam, 1970, p 569. Circular iris-loaded waveguides excited in the HEM deflecting mode, (i.e., combinations of the conventional TE and TM modes) are being used in existing systems, and the use of the $\pi/2$ mode is well known in the art. Eccentric structures have, also, been suggested in IEEE Nucl. Sci. NS-20 No. 3, (1973). However, present-day normal resistance RF separators are not operational for some long pulse length bubble chamber experiments, and/or during long pulses required in conjunction with counter experiments, such as are known in the art, since the required RF power for these applications for normal resistance room temperature separators are beyond the capabilities of existing or conventional room temperture technology. On the other hand, the use of the superconducting deflecting cavities is provided in accordance with this invention in view of its inherently small RF losses. Moreover, measurements on geometrically simple cavities have confirmed that loss improvement factors and peak fields for competitive structures can be achieved.

Referring to FIG. 1, the iris-loaded deflecting cavity means of this invention, which is adapted to be superconducting, to be employed with a conventional RF source and to receive and transport a high energy beam of high energy charged particles along an equilibrium axis 1, comprises an iris-loaded, deflecting cavity means 11 having a right circular OD on axis 1. An RF source means 15 energizes the deflecting cavity with radio-frequency electrical current energy to deflect the charged particles from the equilibrium axis for extracting the particles tangentially from the beam, and cryostatic means 17 having an insulating containment 19 has a cryostatic cooling fluid 23, which circulates through the containment and maintains the eccentric cavity at a temperature below its critical superconducting temperature $T_c$. Since Nb is an advantageous cavity material, liquid He is an acceptable coolant for cooling the cavity to a temperature below the critical superconducting temperature of niobium.

Figure 2A:
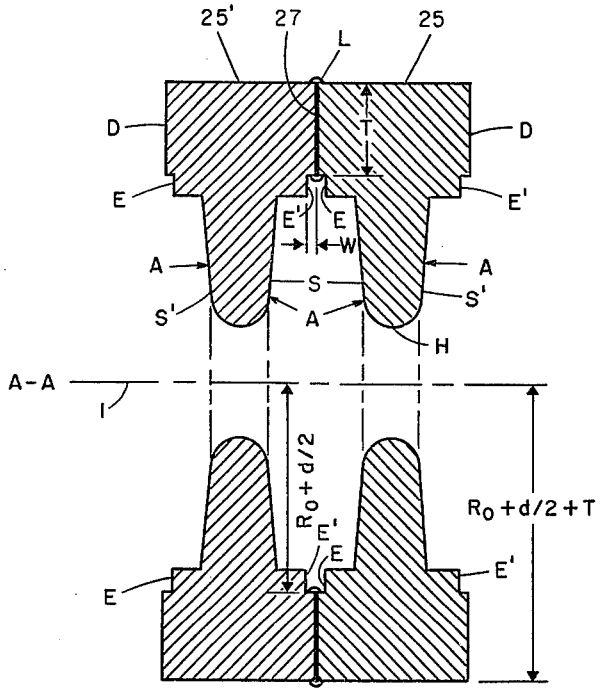
Figure 2B:
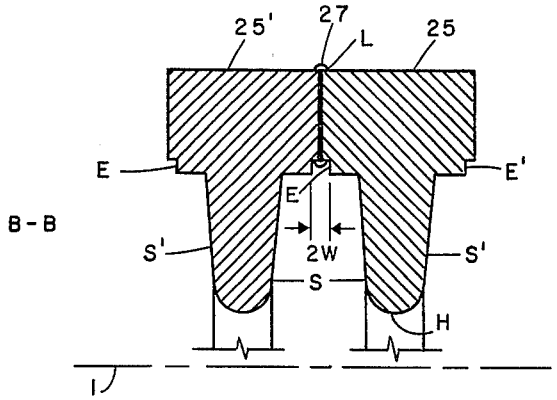
Figure 2C:
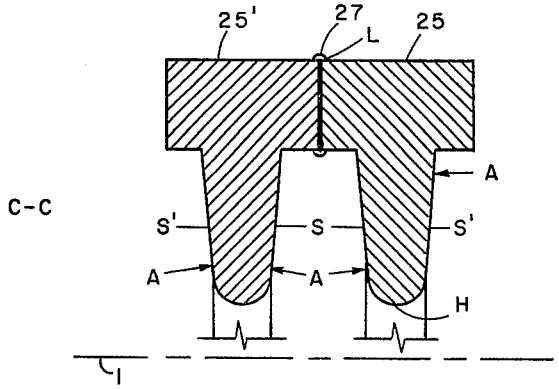

The cavity means 11 comprises duplicate annular discs D that are electron beam welded together to form a longitudinally extending separating cavity, comprising abutting electron beam welded sections e.g., sections 25 and 25', that are butted and circularly welded at circular joints 27 to be vacuum tight and helium tight at the joints, as shown in FIG. 2*a*–2*c*. The fabrication is accomplished by chucking and machining at radius $R_o + T + d/2$, a right circular cylindrical OD centered on an axis 1. Then, using the same center line axis 1, the bore hole H is drilled and the deeply recessed round area A is machined at $R_o$ to form a surface S that slopes toward the bore hole H, which is chamfered, so that surface S and its opposite surface S' form a thinner cross-section as they approach the bore hole H. The fabrication is continued by moving the cavity to the right so that its axis of rotation is at 2 in FIG. 1, machining a circle centered there at a distance $d/2$ from the axis 1. Thus, the new-moon shaped portion between 2' and 2'' is removed using the point 2 as the center of the circle of rotation. To remove the new-moon shaped portion between 3' and 3'' the cavity is moved left back across the LL plane to be centered on the point 3, which is a distance $d/2$ from the center line 1. Both new-moon shaped portions are removed to the depth of the adjoining deeply recessed area A, and both are removed by rotating the cutting tool to cut out circles at radius $R_o$. Then the cavity is recentered on axis 1 and the shallow ledges E and E' are cut out at a depth W in a circle at a radius $R_o + d/2$ to produce a uniform thickness in the wall L to provide for an electron beam weld joint 27 that remains truly circular and of constant thicknes T, while the recessed area A is eccentric thereto.

In operation, each disc D is welded on each side to a like adjoining disc, so that the eccentricities and the shallow ledges E and E' line up with each other. As will be understood in more detail hereinafter, the eccentric deeply cut out regions provide the proper special orientation for both the operational and degenerate modes ($\pi/2$, HEM) which are at right angles to each other, while maintaining a desired large frequency separation therebetween, while permitting a uniform distance of penetration for the electron beam weld at joint 27, and while using a standard machining equipment, comprising laterally moveable chucks for cutting eccentrically arranged and concentrically arranged circles relative to the center line of the cavity means held by the chuck.

The fabrication is accomplished by first machining the OD and bore hole H of the cavity means 11, and then machining the deeply recessed portion A that forms the sloping sides S and S' truly concentric and symmetrical to the cavity center line 1 up to a radius $R_o$. The eccentric portions are then machined by moving the cavity off center in the lathe by $d/2$. The tool is then moved into the work axially at a radius $R_o$ to the required depth. The tool is then moved radially toward the center of the work until it has cleared the sloping (angled) face S. The eccentric portion, therefore, comprising the initial recess and the portion added thereto by removing the new moon portions between 2' and 2'' and between 3' and 3'', is actually a small portion of a cylinder that is repeated on the other half of each disc, so that each side of each disc is symmetrical. The shallow ledges E and E' are cut to a depth W so that the weld joint diameters are visible and truly concentric and symmetrical to the cavity means center line up to $R_o$ at $2R_o + d$ and $2R_o + 2T + d$ to the cavity, where $R_o$ is the initial radius of the cut of the recessed area A, d is the distance from the center line 1 on the mid-plane LL that the cavity means is moved on each side of the center line 1 to cut out the new-moon portions forming the eccentricities described, and T is the uniform thickness for the electron beam welded joint 27 that is provided by the last cut centered on the axis of the cavity means 11 at the radius of $R_o + d/2$.

The outside diameter of the cavity means 11 is cooled by circulating liquid He in the enclosure 19, while the inside of the discs along their bore holes H is maintained at a vacuum. Suitable insulated leads through the enclosed container and coolant connect the discs D to a conventional RF source, while charged particles are received and transported along the center line 1 at right angles to the plane of the paper of FIG. 1.

In considering the electrical characteristics of the FIGS. 2*a*–2*c*, for the deflecting mode, all mode stabilizers have the effect of splitting the dispersion curve into two separate dispersion curves, where the corresponding operating M1 and degenerate M2 modes in each of the dispersion curves are in 90° space quadrature to each other when viewed in FIG. 1. Once an operating mode has been selected (in one of the dispersion curves), it is necessary that a sufficiently large frequency difference exist between it (the operating mode) and any mode in the other dispersion curve. It will now be shown how this frequency difference is related to the parameters $d$ and W.

Measurements were made on a four cell model at 2.8 GHz. Shown in FIG. 3 are the typical dispersion curves obtained. The $\pi/2$ mode in the lower pass band, at $\omega_o$, has been selected as the operating mode, and the frequency separation between it and the upper pass band is $\Delta\omega$. (There are other reasons for selecting this mode, but they will not be discussed here.). The results of these measurements are shown in the table. It should be pointed out that there was no degradation of the Q in any of the measured structures at the $\pi/2$ mode in the lower band pass, while providing the desired mode splitting by providing the desired frequency spacing between the operating mode and the upper dispersion curve.

For a practical operating $\pi/2$ mode structure, a minimum $\Delta\omega/\omega_o$ of 0.003 would be desirable. To accomodate the electron beam welding, the width W should be at least 2 mm. From the table it is seen that there is essentially no field in the gap for the operating $\pi/2$ mode, since $\Delta\omega/\omega_o$ changes very slowly for changes of W as compared to changes in $d$.

-continued

| $d$ (mm) | $W$ (mm) | $\frac{\Delta\omega}{\omega_0}$ |
|---|---|---|
| 0.61 | 0 | 0.0055 |
| 0.61 | 1.0 | 0.0035 |
| 0.61 | 2.0 | 0.00176 |
| 0.76 | 2.0 | 0.006 |

This invention has the advantage of providing a Nb superconducting charged particle separator having a cavity means for receiving and transmitting charged particles along the center line of the cavity, wherein the cavity, which forms cavity walls that are cut eccentric to the center line by conventional circular machining, has a uniform thickness joint that is electron beam welded by a conventional apparatus.

What is claimed is:

1. In apparatus for receiving and transporting a high energy beam of charged particles along an equilibrium axis having an RF separator forming an iris-loaded deflecting cavity for extracting charged particles from the beam tangentially to said axis, the improvement comprising:

a. an eccentric-shaped iris-loaded deflecting cavity means arranged along the equilibrium axis, said deflecting cavity being formed from circular disc-shaped electron-beam welded sections that are butted and circularly welded, at uniform thickness, flat, non-stepped circular joints;

b. means for energizing the deflecting cavity means with radio-frequency electrical energy to deflect the charged particles from the equilibrium axis for extracting the particles tangentially from the beam; and c. means for maintaining the deflecting cavity means at superconducting temperatures.

2. The deflecting cavity means of claim 1 in which the cavity means is made of Nb.

3. The deflecting cavity of claim 2 in which the cavity means is superconducting Nb having an eccentric inside diameter around an annulus for receiving and transporting the charged particles, and in which said means for maintaining the deflecting cavity means to be superconducting comprises liquid He, and an enclosure around the outside of the cavity means for circulating the liquid He along the outside of the cavity means.

4. The deflecting cavity of claim 3 in which the joints are electron beam welded and have optically visible uniform thickness welds for effective mode stabilization at superconducting temperatures.

* * * * *